US009265111B2

(12) United States Patent
Cavalcanti et al.

(10) Patent No.: US 9,265,111 B2
(45) Date of Patent: Feb. 16, 2016

(54) LIGHTING REQUIREMENTS GENERATION SYSTEM AND METHOD

(75) Inventors: Dave Alberto Tavares Cavalcanti, Mahopac, NY (US); Jianfeng Wang, Ossining, NY (US); Stefanie Brauers, Aachen (DE); Jens Friedemann Marschner, Wuerselen (DE); Kiran Srinivas Challapali, New City, NY (US)

(73) Assignee: Koninklijke Philips N.V., Eindhoven (NL)

( * ) Notice: Subject to any disclaimer, the term of this patent is extended or adjusted under 35 U.S.C. 154(b) by 218 days.

(21) Appl. No.: 14/126,089

(22) PCT Filed: Jun. 25, 2012

(86) PCT No.: PCT/IB2012/053181

§ 371 (c)(1),
(2), (4) Date: Dec. 13, 2013

(87) PCT Pub. No.: WO2013/005127

PCT Pub. Date: Jan. 10, 2013

(65) Prior Publication Data

US 2014/0285107 A1 Sep. 25, 2014

Related U.S. Application Data

(60) Provisional application No. 61/503,738, filed on Jul. 1, 2011.

(51) Int. Cl.

| | |
|---|---|
| ***H05B 39/04*** | (2006.01) |
| ***H05B 33/08*** | (2006.01) |
| ***H05B 37/02*** | (2006.01) |

(52) U.S. Cl.
CPC ..... *H05B 33/0842* (2013.01); *H05B 37/0245* (2013.01)

(58) Field of Classification Search
CPC ..... H05B 39/04
See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 8,786,198 | B2 * | 7/2014 | De Groot | H05B 37/0227 315/152 |
| 2009/0149973 | A1 | 6/2009 | Keller et al. | |

(Continued)

FOREIGN PATENT DOCUMENTS

| | | | |
|---|---|---|---|
| CN | 101765271 | A | 6/2010 |
| CN | 201623802 | U | 11/2010 |

(Continued)

*Primary Examiner* — Hai L Nguyen

(57) ABSTRACT

An OLN lighting requirements generation system and method including a lighting requirements generation system for an outdoor lighting network (OLN, 90) having lighting units (82), the system having a central control apparatus (40); a plurality of lighting unit control apparatus (50); and a communication system (60) operably connecting the central control apparatus (40) and the lighting unit control apparatus (50). The central control apparatus (40) is operable to: acquire location-based data; define clusters from the location-based data; define lighting requirements for each of the clusters; associate the lighting units (82) to the clusters from location information for the lighting units; map the lighting units (82) to the lighting requirements; and implement the lighting requirements of the clusters associated with each of the lighting units (82).

16 Claims, 4 Drawing Sheets

(56) References Cited

U.S. PATENT DOCUMENTS

| | | | |
|---|---|---|---|
| 2010/0029268 | A1 | 2/2010 | Myer et al. |
| 2010/0250106 | A1 | 9/2010 | Bai et al. |
| 2010/0262296 | A1 | 10/2010 | Davis et al. |

FOREIGN PATENT DOCUMENTS

| | | | |
|---|---|---|---|
| WO | 2007003038 | A1 | 1/2007 |
| WO | 2010004488 | A1 | 1/2010 |

* cited by examiner

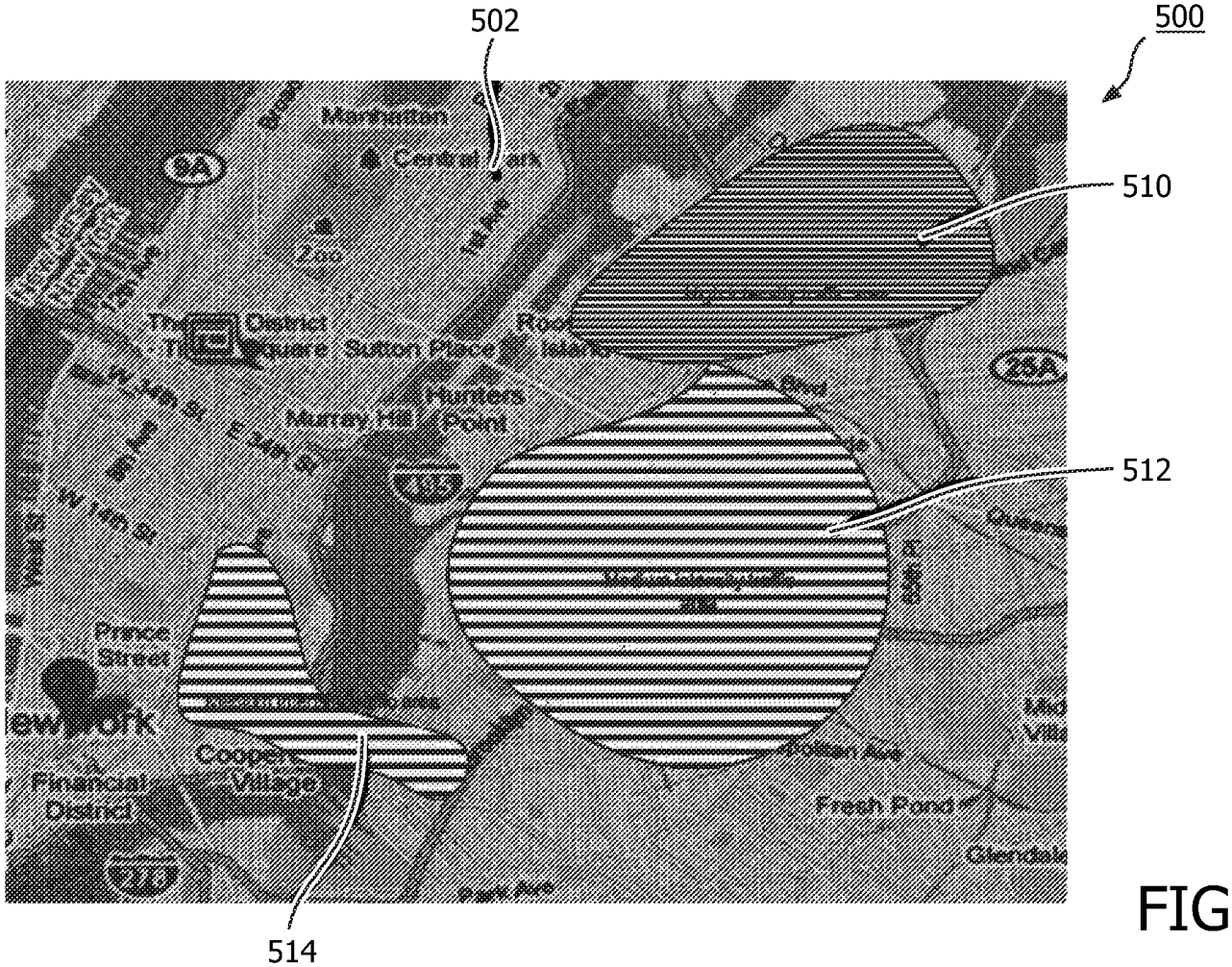
500
510
512
502
514
Mamaroneck
Central Ave
Mamaroneck Ave
Rockland Place
Station Place
District Square
Mamaroneck Ave
Hunters Point
Mamaroneck Ave
Prince Street
Cooper Village
Fresh Pond Rd
Clearview Ave
Bruce Ave
Bruce Ave
Mid Vill
Clearview
Rockland Place
Rockland Place
Rockland Place

LIGHTING REQUIREMENTS GENERATION SYSTEM AND METHOD

CROSS-REFERENCE TO PRIOR APPLICATIONS

This application is the U.S. National Phase application under 35 U.S.C. §371 of International Application No. PCT/2012/053181, filed on Jun. 25, 2012, which claims the benefit of, U.S. Provisional Patent Application No. 61/503,738 filed on Jul. 1, 2011. These applications are hereby incorporated by reference herein.

The technical field of this disclosure is outdoor lighting networks (OLNs), particularly, outdoor lighting requirements generation systems and methods.

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a controller for independently controlling the output of the LEDs in order to generate a variety of colors and color-changing lighting effects, for example, as discussed in detail in U.S. Pat. Nos. 6,016,038 and 6,211,626, incorporated herein by reference.

Outdoor lights, such as lighting for roadways, streets, parking facilities, parks, landscapes, footpaths, and bicycle paths, are normally managed by a single authority. For example, street lights in New York City are managed by the Department of Transportation. Central control by one authority allows better security, better coordination of use, and reduced maintenance cost. Most outdoor lights currently operate independently or in small groups supplied from a common power source. However, with the rise of the Internet and wireless communication systems, there is a trend toward networking of outdoor lights and managing operation of the outdoor lights through a centralized server.

The new generation lights like LEDs have the capability to adjust dimming level, color, direction (e.g., by tilting LED panels or digitally forming LED light beams), and/or harvesting various energy sources (e.g., solar/wind power). The new generation of light sources also frees the design of luminaires and fixtures to provide more choices for customers. In other words, the outdoor lighting network becomes more and more heterogeneous. This allows additional flexibility in saving energy, reducing light pollution, and complying with local lighting regulations. Unfortunately, the present generation of outdoor lighting does not employ a control and management system that is able to take advantage of this flexibility.

One problem with current lighting systems is the inability to capture changing regulatory policies and location specific user needs, and provide a translation of such needs into lighting requirements. Different areas/zones have different lighting requirements which may change over time subject to regulation from city, state, or federal entities. For instance, model lighting ordinances can be defined by municipalities specifying lighting zone requirements. In addition, other aspects may be considered by the users (e.g., city managers) when defining lighting requirements, such as safety, security, emergency, traffic, construction, etc. Location specific data, such as traffic information, security data (e.g., crime statistics), area/zoning classifications, and lighting ordinances, could be used for determining location specific user needs.

Unfortunately, present systems require the lighting managers to manually specify lighting requirements taking into account the location specific data, which is impractical because of the large effort involved. Although existing OLN management tools give operators the flexibility to set up schedules for different areas of the city (e.g., business districts, residential areas, highways, etc.), the operator has to make the decision on the type of operating schedule and manually apply the selected schedule to each light unit or groups of light units. Therefore, the user is responsible for ensuring the schedule is complaint with any applicable regulations as the current management tools do not take into account regulations when defining schedules. Furthermore, other location specific aspects that may impact the lighting requirements, such as safety, security, business, and traffic needs, are not taken into account in the existing management tools.

It would be desirable to have a lighting requirements generation system and method that would overcome the above disadvantages.

One aspect of the invention provides a lighting requirements generation system for an outdoor lighting network (OLN) having lighting units, the system having a central control apparatus; a plurality of lighting unit control apparatus; and a communication system operably connecting the central control apparatus and the lighting unit control apparatus. The central control apparatus is operable to: acquire location-based data; define clusters from the location-based data; define lighting requirements for each of the clusters; associate the lighting units with the clusters from location information for the lighting units; and location-based data for the area; map the lighting units to the lighting requirements; and implement the lighting requirements of the clusters associated with each of the lighting units.

Another aspect of the invention provides a central control apparatus of a lighting requirements generation system for an outdoor lighting network (OLN) having lighting units and being operably connected to an agent, the apparatus having a processor; a memory operably connected to the processor; and a communication module operably connected to the processor for communication with the agent. The processor is operable to: acquire location-based data from the agent; define clusters from the location-based data; define lighting requirements for each of the clusters; associate the lighting units with the clusters from location information for the lighting units; map the lighting units to the lighting requirements; and implement the lighting requirements of the clusters associated with each of the lighting units.

Another aspect of the invention provides a method of generating lighting requirements for an outdoor lighting network (OLN) having lighting units and being operably connected to an agent, the method including acquiring location-based data from the agent; defining clusters from the location-based data; defining lighting requirements for each of the clusters; associating the lighting units with the clusters from location information for the lighting units; mapping the lighting units to the lighting requirements; and implementing the lighting requirements of the clusters associated with each of the lighting units.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

In the drawing figures, like reference characters generally refer to the same parts throughout the different views. Also, the drawing figures are not necessarily to scale, emphasis instead generally being placed upon illustrating the principles of the invention.

FIG. 5 is an exemplary embodiment of a cluster definition graphical user interface for an outdoor lighting network in accordance with the invention.

Figure 1:
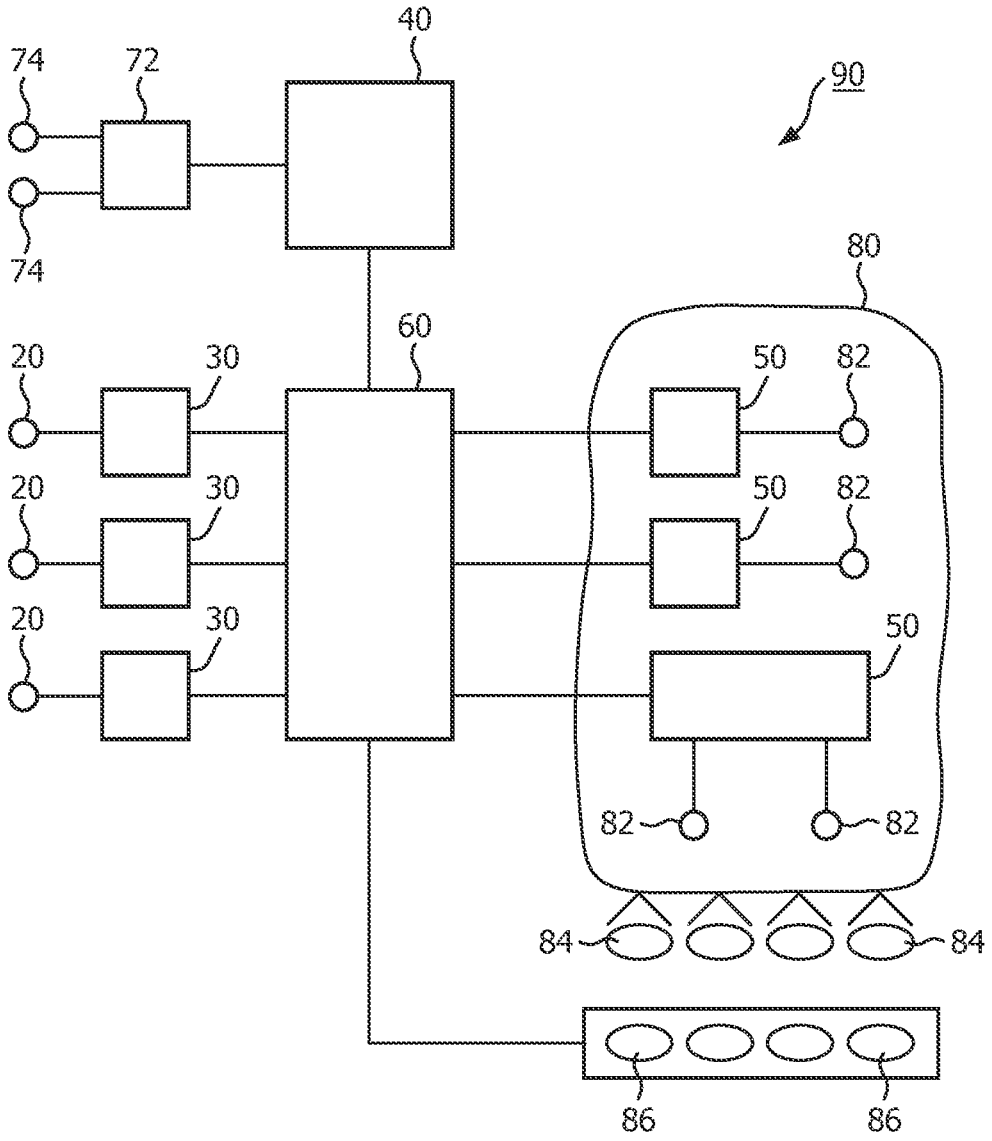
FIG. 1 is a block diagram of an exemplary embodiment of an outdoor lighting network including a lighting requirements generation system in accordance with the invention.

FIG. 1 is a block diagram of an exemplary embodiment of an outdoor lighting network including a lighting requirements generation system in accordance with the invention. FIG. 1 provides an overview of the OLN system with a lighting requirements generation system, which enables automatic generation of lighting requirements for operation, management, change, and optimization of an outdoor lighting network (OLN). Details for the specific apparatus of the overall OLN lighting requirements generation system, including the central control apparatus and the lighting unit control apparatus, are provided in FIGS. 2 and 3, respectively.

Referring to FIG. 1, the OLN system 90 in this example includes a number of optional user control apparatus 30; a central control apparatus 40; a number of lighting unit control apparatus 50; and a communication system 60 operably connected between the optional user control apparatus 30, the central control apparatus 40, the lighting unit control apparatus 50. The OLN system 90 can also include lighting units 82, each of the lighting units 82 being associated with one of the lighting unit control apparatus 50. The lighting units 82 of the OLN system 90 illuminate a number of points of interest 84, such as parks, roads, or the like. None, one, or a number of lighting units 82 can be associated with each point of interest 84.

The central control apparatus 40 can perform lighting requirement generation; OLN planning, change management, and optimization; and lighting unit control apparatus 50 operation and configuration. In generating lighting requirements, the central control apparatus 40 can receive location-based data regarding regulation, public safety, traffic, and user requests. Exemplary regulations can come from federal, state, or city authorities, and can be different for different highway, street, park, or residential areas. Exemplary public safety and traffic data can include crime index maps, traffic maps, construction maps, or the like. Exemplary user requests can come from emergency responders or the like. The location-based data can be provided by agents 74 through telemanagement stations 72, by users 20 through optional user control apparatus 30, by other sources (not shown) through the communication system 60, or by other sources (not shown) directly to the central control apparatus 40.

The OLN system 90 can also include one or more telemanagement stations 72 in communication with the central control apparatus 40 to allow one or more agents 74 to provide input to the lighting requirements generation system of the OLN system 90. The agent 74 can be any party providing input to the OLN lighting requirements generation system 90, such as user agents, administrator agents, power supplier agents, regulatory agents, or the like. The telemanagement station 72 can be in communication with the central control apparatus 40 directly by being connected to the central control apparatus 40 or can be connected to the central control apparatus 40 through the communication system 60. The users 20 can also be in communication with the central control apparatus 40 through the optional user control apparatus 30.

The OLN system 90 with a lighting requirements generation system automatically manages changes (e.g., changes in light characteristics, lighting requirements, energy cost/availability, and the like) of light networks and (re)optimizes the operation of a light network for the changes. Each lighting unit 82 registers its settings, operation characteristics, and capabilities with the central control apparatus once the lighting unit 82 is installed and sends the update of its operation characteristics regularly or on-demand (e.g., as characteristics change) to the central control apparatus 40 via the communication system 60. The communication system 60 can use any communication method or protocol available, for example OLN, WiFi, Ethernet, powerline networks, cellular networks, ZigBee, or the like. The central control apparatus 40 can use the light characteristics and capabilities to calculate the illuminance model and cost model for the OLN system 90.

Figure 2:
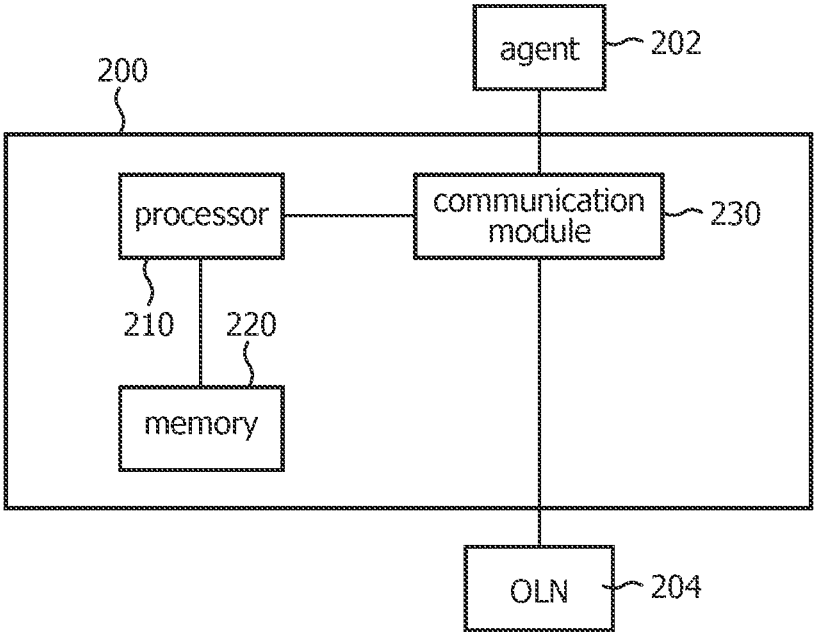
FIG. 2 is a block diagram for an exemplary embodiment of a central control apparatus for an outdoor lighting network in accordance with the invention.

FIG. 2 is a block diagram for an exemplary embodiment of a central control apparatus 200 operatively connected to an outdoor lighting network 204 and an agent 202 in accordance with the invention. The central control apparatus can be implemented in a processor, microprocessor, server, computer, or any other intelligent device with access to the user and the outdoor lighting network. The central control apparatus can be located in a central location or can be distributed over a number of locations.

The central control apparatus 200 generate lighting requirements, enabling an operator to change and optimize an outdoor lighting network (OLN) having lighting units and being operably connected to an agent. The central control apparatus 200 includes a processor 210; a memory 220 operably connected to the processor 210; and a communication module 230 operably connected to the processor 210 for communication with the agent 202 and the outdoor lighting network 204. The processor 210 is operable to acquire location-based data from the agent; define clusters from the location-based data; define lighting requirements for each of the clusters; associate each of the lighting units with clusters from location information for the lighting units; and implement the lighting requirements of the clusters associated with each of the lighting units. The lighting requirements can include average intensity, uniformity, color temperature, and/or the like. In one embodiment, the implementation includes sending the final lighting requirements output plan to a planning/optimization module in the central control apparatus for use in planning, change management, and/or optimization of operation on the outdoor lighting network. In another embodiment, the implementation includes sending the final lighting requirements output plan to the lighting units. In one embodiment, the processor 210 is further operable to resolve conflicts between the lighting requirements of the clusters associated to at least one of the lighting units before implementing the lighting requirements.

The memory 220 stores data and commands for managing change and optimization of the outdoor lighting network. The memory 220 can store configuration requests, optimization objectives/constraints, lighting requirements, illuminance model, cost model, and the like.

The communication module 230 receives changes from agents and lighting unit apparatus, and coordinates the operation of the lighting units associated with the points of interest involving the changes. The communication module 230 can be any type of device that can communicate with the agent 202 and/or the outdoor lighting network 204, such as a ZigBee chip, radio chip with an application layer, application-specific integrated circuit (ASIC), or the like. The communication module 230 can communicate using any desired technology, such as a cellular data communication protocol (e.g., GSM, CDMA, GPRS, EDGE, 3G, LTE, WiMAX), ZigBee protocol operating on top of the IEEE 802.15.4 wireless standard, WiFi protocol under IEEE standard 802.11 (such as 802.11b/g/n), Bluetooth protocol, Bluetooth Low Energy protocol, or the like. In one example, the communication module 230 communicates with the agent 202 and/or the outdoor lighting network 204 through a communication system.

The processor 210 determines how to optimize lighting unit operation. The processor 210 can be any type of device that can perform one or more of the following: create instructions, execute instructions, and/or process data in accordance with instructions. In one example, the processor is a computer, such as a personal computer, server, or the like. The memory 220 can be any type of memory capable of storing data, programs, and/or instructions. Exemplary memory includes random access memory (RAM), read-only memory (ROM), flash memory, magnetic computer storage devices (e.g. hard disks, floppy discs, and magnetic tape), optical discs, and the like. The memory 220 can be used for long term and/or short term storage.

Figure 3:
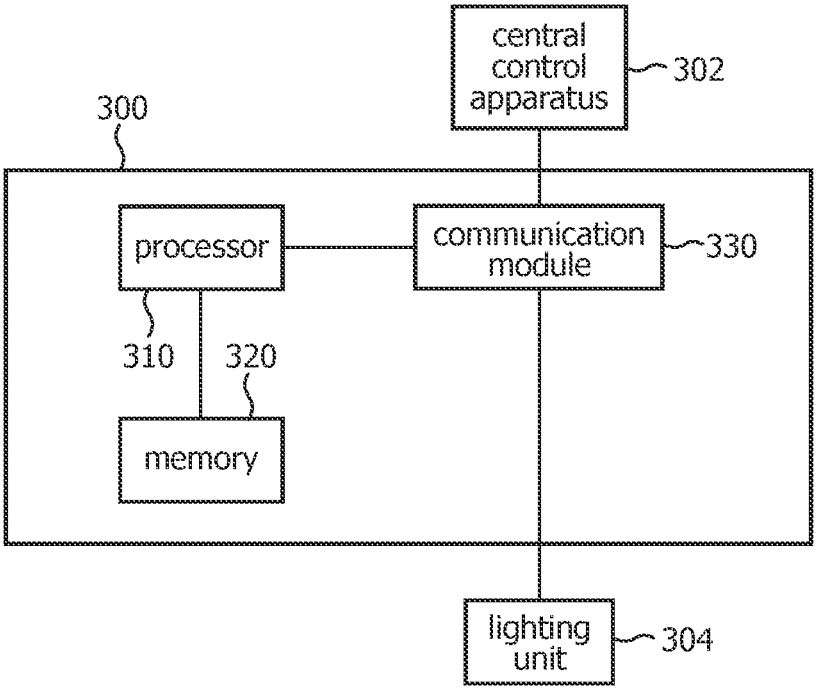
FIG. 3 is a block diagram for an exemplary embodiment of a lighting unit control apparatus for an outdoor lighting network in accordance with the invention.

FIG. 3 is a block diagram for an exemplary embodiment of a lighting unit control apparatus operably connected to a central control apparatus of an outdoor lighting network (OLN) in accordance with the invention. The lighting unit control apparatus can be implemented in a processor, microprocessor, computer, embedded system, or any other electronic device with access to the user and the central control apparatus. The lighting unit control apparatus can be located conveniently in or near the lighting units, such as in a luminaire/fixture, a ballast, an LED driver, an LED panel, a light pole, an associated software/electronics module, or the like. The lighting unit control apparatus can be used to control an individual lighting unit or a group of lighting units. Those skilled in the art will appreciate that the lighting requirements generation system can be used without the lighting unit control apparatus or the lighting units installed or available. The lighting requirements generation system can run on a personal computer or central control system during planning when information about the locations of the lighting units is available, but the lighting units themselves are not yet available.

The lighting unit control apparatus 300 can control operation of associated lighting units in accordance with the lighting requirements. The lighting unit control apparatus 300 includes a processor 310; a memory 320 operably connected to the processor 310; and a communication module 330 operably connected to the processor 310 for communication between the central control apparatus 302 and the lighting unit 304.

The processor 310 is operably connected to the central control apparatus through the communication module 330. The processor 310 is operable to receive operation instructions for controlling operation of the lighting units in coordination with other lighting units to collectively optimize light operation in response to changes over a point of interest. The processor 310 is further operable to provide lighting unit characteristics either initially when the lighting units are installed or after the lighting units are changed after installation. The initial lighting unit characteristics can include the location, height, orientation, light device type, and/or the like for the lighting units. In one embodiment, the initial lighting unit characteristics can also include an illuminance model based on a theoretical/empirical model. The change lighting unit characteristics can include changeable current attributes for the lighting units, such as environmental conditions, dimming curve, burning hours, renewable energy type (e.g., energy available at the lighting unit such as solar, wind, or the like), renewable energy availability (e.g., battery charge, cloudiness, wind speed, or the like).

The processor 310 can be any type of device that can perform one or more of the following: create instructions, execute instructions, and/or process data in accordance with instructions. In one example, the processor is a computer, such as a personal computer, server, or the like. The memory 320 can be any type of memory capable of storing data, programs, and/or instructions. Exemplary memory includes random access memory (RAM), read-only memory (ROM), flash memory, magnetic computer storage devices (e.g. hard disks, floppy discs, and magnetic tape), optical discs, and the like. The memory 320 can be used for long term and/or short term storage.

The communication module 330 can be any type of device that can communicate with the central control apparatus 302 and/or the lighting unit 304, such as a ZigBee chip, radio chip with an application layer, application-specific integrated circuit (ASIC), or the like. The communication module 330 can communicate using any desired technology, such as a cellular data communication protocol (e.g., GSM, CDMA, GPRS, EDGE, 3G, LTE, WiMAX), ZigBee protocol operating on top of the IEEE 802.15.4 wireless standard, WiFi protocol under IEEE standard 802.11 (such as 802.11b/g/n), Bluetooth protocol, Bluetooth Low Energy protocol, or the like. In one example, the communication module 330 communicates with the central control apparatus 302 and/or the lighting unit 304 through a communication system.

Figure 4:
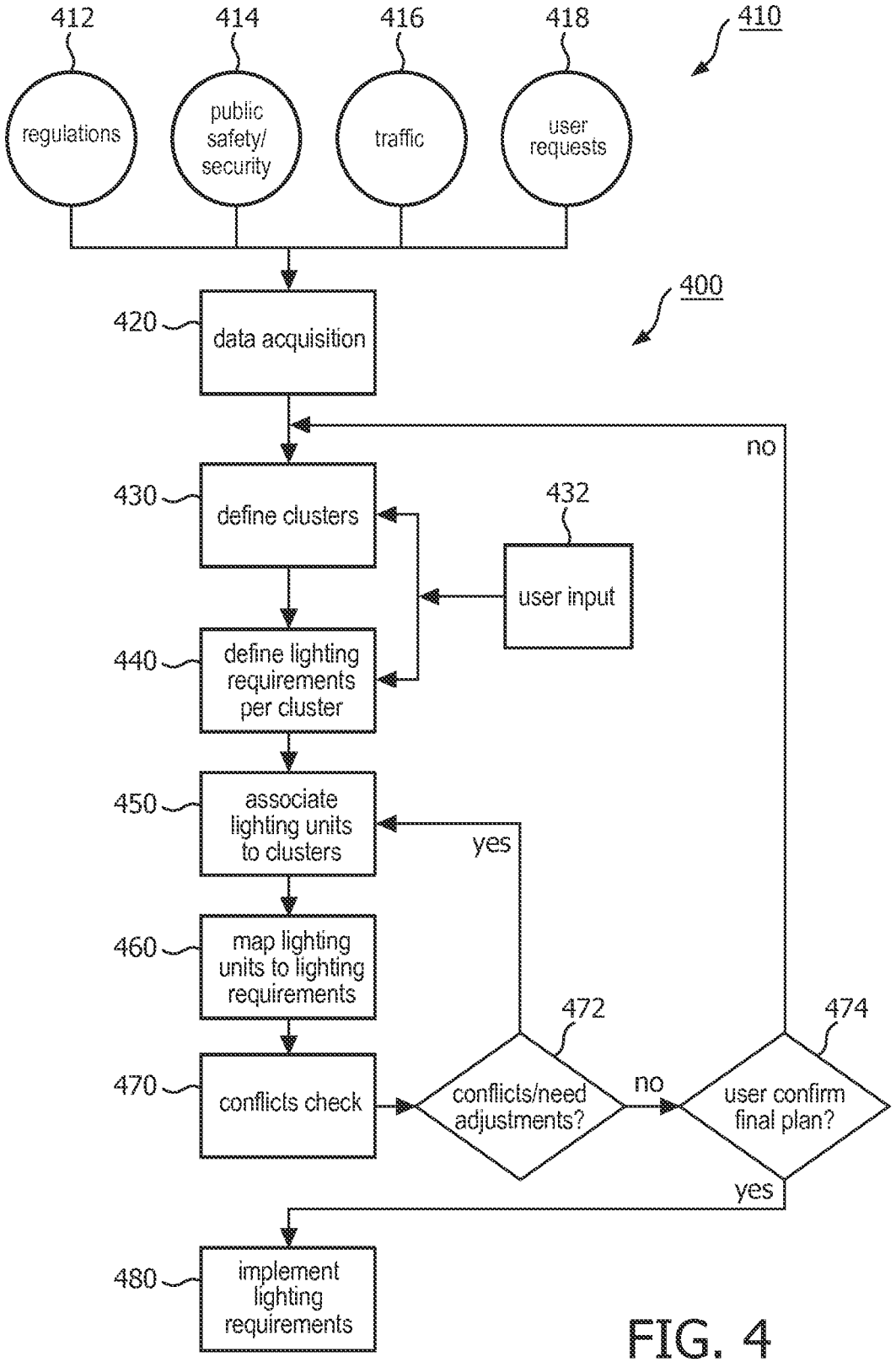
FIG. 4 is a flowchart of a method for OLN lighting requirements generation for an outdoor lighting network in accordance with the invention.

FIG. 4 is a flowchart of a method for lighting requirements generation for an outdoor lighting network in accordance with the invention. The lighting requirements can include lighting parameters, such as intensity, uniformity, color temperature, and the like, over an area of interest, such as a street, park, or any other area of interest. The lighting requirements can be defined based on user preferences, regulation requirements, and the like. Changes to the lighting requirements can result from changes in user preferences, regulations, city zoning rules, construction, and/or environmental conditions (e.g., traffic, weather, time of day or night, and the like). In one embodiment, the lighting requirements over an area are represented as the combination of average intensity (illuminance), uniformity, and color temperature. Illuminance and uniformity metrics include percent of grid points illuminated (GPI), average illuminance, coefficient of variation (CV), average-to-min uniformity ratio (AMU), and max-to-min uniformity ratio (MMU).

FIG. 4 provides an overview of the method from the viewpoint of the central control apparatus. The OLN has lighting units and is operably connected to an agent. The method 400 includes acquiring location-based data from the agent 420; defining clusters from the location-based data 430; defining lighting requirements for each of the clusters 440; associating the lighting units to the clusters from location information for the lighting units 450; mapping the lighting units to the lighting requirements 460; and implementing the lighting requirements of the clusters associated with each of the lighting units 480. The method 400 can optionally include checking for conflicts 470 between the lighting requirements of clusters associated to one or more of the lighting units, and to resolve the conflicts when found.

Acquiring location-based data from the agent 420 can include acquiring location-based data from agents such as regulatory agents 412, public safety/security agents 414, traffic agents 416, user agents 418, or the like. An agent as defined herein is any data storage facility, computer/server, or storage repository from which location-based data can be obtained. The location-based data can be stored in digital, analog, and/or hard copy form. The regulatory agents 412 can provide location-based data such as federal/state/city laws or regulations, zoning regulations, lighting ordinances, lighting codes, or the like. The public safety/security agents 414 can provide location-based data such as crime statistics, construction maps, or the like. The traffic agents 416 can provide location-based data such as traffic statistics, traffic density, volume, or the like. The user agents 418 can be emergency responders, event planners, or the like, and can provide location-based data such as emergency activities, scheduled or unscheduled events, or the like.

The location-based data can be any data of interest which is associated with any location of interest. For example, the location-based data could be lighting ordinances as a function of location about a city. The location-based data can be in any format desired for a particular purpose, including computer encoded information, hard copy documents, or the like. In one example, the location-based data is historical data. Another example, the location-based data is a real-time data.

The location-based data can be acquired from the agent in various ways. In one embodiment, the central control apparatus can collect location-based data stored on databases or servers, such as city databases or servers. In one example, regulatory information, city planning, and/or city codes can be maintained in Web accessible repositories to which the central control apparatus can connect and extract location-based data using authorized security credentials. In another embodiment, the agent can manually input the location-based data to the central control apparatus by uploading files (e.g., standards documents, city codes, traffic statistics, etc.). The files can be analyzed to extract the relevant location-based data. In yet another embodiment, the agent as a user can manually input the location-based data to the central control apparatus through a graphic user interface (GUI). The agent can use input data about traffic, crime, ongoing construction, or other data of interest to define index maps in which each location is associated with an index that reflects the intensity of the parameter represented (e.g., crime rate, traffic intensity, etc.). In one example, the index is a numerical value within a predefined range. In another example, the index is a graphical representation of the parameter displayed on a GUI with different color scales, patterns, and/or other graphical devices.

Defining clusters from the location-based data 430 can include defining various types of clusters as desired for a particular application. A cluster represents a specific characteristic that can be associated with a geographical location, and therefore associated with lighting units in the geographical location. The geographical location can be defined directly, such as definition by map coordinates, or indirectly, such as by a lighting unit number. More than one cluster can be associated with a particular geographical location or lighting unit. In one embodiment, defining clusters from the location-based data 430 can further include defining clusters from the location-based data with user input 432.

The cluster can be a single parameter cluster, a meta-cluster, or a scaled cluster. A single parameter cluster as defined herein represents a single characteristic associated with a geographical location. Examples of single parameter clusters include area classification clusters (business district areas, residential areas, major roadways); traffic base clusters (high traffic volume areas, low traffic volume areas); and safety and security clusters (low crime rate areas, high crime rate areas).

The meta-cluster as defined herein represents multiple characteristics associated with a geographical location. In one embodiment, the user can select the particular multiple characteristics for the meta-cluster to identify areas of interest. For instance, a meta-cluster could combine the characteristics of high traffic volume, business districts, and low crime rates.

The scaled cluster as defined herein represents degrees of a single characteristic associated with a geographical location. A number of scaled clusters can be defined for a single characteristic. In one example, a low intensity cluster can be defined when the characteristic of interest is below a threshold and a high-intensity cluster can be defined when the characteristic of interest is above the threshold. In another example, different intensity clusters can be defined for low, medium, and high values of the characteristic of interest. Applying this to the example of crime rate for a given area as the characteristic of interest, a low crime area cluster could be defined when the crime rate is less than a low threshold, the medium crime area cluster could be defined when the crime rate is between the low threshold and a high threshold, and a high crime area cluster could be defined when the crime rate is above the high threshold. The scaled cluster can be used for any category with any threshold as desired for a particular application.

Existing geographic information systems (GISs) available for a particular city or other location can define clusters and generate street maps showing lighting unit positions. In one embodiment, the central control apparatus can communicate with any available GIS to obtain location-based data or other information useful in defining the clusters. For example, government officials, city officials, or managers can use existing city GISs to define specific clusters, such as clusters based road/area classification, crime statistics, traffic volume, or the like. Defining clusters with the use of a GUI is discussed further below in association with FIG. 5.

Referring to FIG. 4, defining lighting requirements for each of the clusters 440 can include defining lighting requirements $S_k$ for every cluster $C_k$. The lighting requirements $S_k$ can include several operational parameters Pj. For example, lighting requirements $S_k$ can be a set with {P1=min output, P2=max output, P3=max CCT, . . . }. In one embodiment, defining lighting requirements for each of the clusters 440 can further include defining clusters from the location-based data with user input 432. The lighting requirements can be extracted from applicable regulations or derived from a combination of preferences indicated by the users in the acquiring location-based data. In another embodiment, the users can create meta-clusters that combine different characteristics (e.g., area classification, traffic volume, crime rate, etc.) and associate specific lighting requirements to particular meta-clusters based on the user's input. For example, downtown business districts/areas with high traffic flow could be a pre-defined meta-cluster that would be associated with specific lighting requirements selected by city officials/managers.

Associating the lighting units to the clusters from location information for the lighting units 450 can determine which lighting unit locations satisfy the location characteristics of a given cluster. In one embodiment, a clustering function $f_k(i)$ is defined for every cluster $C_k$, with the lighting unit identity input i being lighting unit identity information such as a lighting unit number or lighting unit location. The clustering function $f_k(i)$ generates a value that determines whether the lighting unit is to be associated with the cluster $C_k$. In one example, the lighting unit geographical location is provided as the lighting unit identity input i and the clustering function $f_k(i)$ returns a numeric value or a binary value (0 or 1) indicating whether the lighting unit indicated by the lighting unit identity input i is to be associated with the cluster $C_k$.

The clustering function $f_k(i)$ relates the specific characteristic of a given cluster $C_k$ to a lighting unit and/or a lighting unit geographic location. In one example, the specific characteristic is a geographical characteristic such as a type of area, e.g., a business district, residential, or roadway area as defined by the city. The clustering function for the geographical characteristic determines the cluster to which the lighting unit should be associated. In another example, the specific characteristic is a quantitative characteristic, such as high crime rate. The clustering function determines whether the crime rate at the lighting unit's geographical location should be associated to a high crime rate cluster by comparing the crime rate information available about the area with a threshold for a high crime rate area.

Mapping the lighting units to the lighting requirements 460 can include determining a cluster set of those clusters associated with a particular lighting unit, then defining the lighting requirements for the particular lighting unit from the lighting requirements for the cluster set.

For each lighting unit, the central control apparatus determines a cluster set Clusters(i) of those clusters $C_k$ associated with the particular lighting unit. In one embodiment, the clustering function $f_k(i)$ can be evaluated against an association criteria to determine if a cluster $C_k$ should be in the cluster set Clusters(i) for a lighting unit having the lighting unit identity input i. In one example, the association criteria is based on a clustering function $f_k(i)$ and a threshold value $TH_k$ such that $C_k \epsilon$Clusters(i), if $f_k(i) \geq TH_k$, and in another example, the association criteria is based on a threshold range ($TH_{kmin}$, $TH_{kmax}$) such that $C_k \epsilon$Clusters(i), if $TH_{kmin} \leq f_k(i) \leq TH_{kmax}$.

When a cluster set Clusters(i) has been determined for every lighting unit of interest, the central control apparatus determines lighting requirements for each of the lighting units from the lighting requirements of the different clusters in the cluster set for each particular lighting unit. The determination of lighting requirements can take into account the lighting requirements for each of the different clusters in the cluster set. Exemplary processes for determining the lighting requirements include max/min, pre-defined requirements for meta-clusters, and weighted sum.

In the max/min process as defined herein, the lighting requirements for a given lighting unit are defined as a max/min{$S_k$} for all clusters $C_k$ in cluster set Clusters(i), i.e., the maximum or minimum value of an operational parameter $P_i$ is selected for a particular lighting unit from all of the values of the operational parameter $P_i$ found in any cluster $C_k$ in the cluster set Clusters(i). Those skilled in the art will appreciate that the maximum or minimum value is used depending on the appropriateness for the particular operational parameter. For example, if the operational parameter is maximum light output, the minimum value found in any cluster $C_k$ in the cluster set Clusters(i) can be selected since that would be the limiting value for all of the clusters.

In the pre-defined requirements for meta-cluster process as defined herein, the lighting requirements for a given lighting unit are defined as the lighting requirements for a meta-cluster associated with a particular lighting unit when a meta-cluster is associated with a particular lighting unit. Specific lighting requirements $S_k$ can be assigned to a meta-cluster as desired for a particular type of area or application when defining a meta-cluster. For example, when a cluster is defined as a meta-cluster having residential areas and low crime rate areas, a lighting requirement of minimum illumination can be assigned to that meta-cluster and used for any lighting unit associated with that meta-cluster. When a given lighting unit is associated with more than one meta-cluster, the lighting requirements can be determined by the max/min or weighted sum method.

In the weighted sum process as defined herein, the lighting requirements for a given lighting unit are defined by the weighted average the lighting requirements for all clusters associated with the given lighting unit. In one embodiment, the weighted average is weighted by the importance of each cluster so that $$Req(i) = \sum_{AllC_k \in Clusters(i)} \alpha_k S_k,$$

where Req(i) is the lighting requirement for the lighting unit identified by lighting unit identity input i, $\alpha_k$ is the weighting factor for the lighting requirements of cluster $C_k$, and $S_k$ is the lighting requirement of cluster $C_k$. In one example, the weighting factor $\alpha_k$ is the relative importance of each cluster $C_k$. In one example, the lighting requirements are max output power requirements P1, P2, and P3, associated with three clusters $C_1$, $C_2$, and $C_3$, respectively, each cluster $C_1$, $C_2$, and $C_3$ is associated with a weighting factor $\alpha_1$, $\alpha_2$, and $\alpha_3$, respectively, which represent the importance of each cluster. Thus, the overall output power requirements (lighting requirements) for a lighting unit associated with the three clusters according to this method would be defined as $$P = \sum_{i=1}^{3} \alpha_i Pi.$$

When lighting requirements for each of the lighting units have been determined, the central control apparatus can optionally check for conflicts 470 between the lighting requirements and any applicable regulation, user preference, or other location-based data, and resolve the conflicts when found. When conflicts are detected or adjustments needed 472, the central control apparatus can return to associating the lighting units with the clusters from location information for the lighting units 450 and automatically adjust the associations to cure the conflicts. In one example, before the associating 450, the central control apparatus can automatically re-define the criteria for association with the clusters, by changing the association criteria thresholds and/or the clustering function. In another example, before the associating 450, the central control apparatus can automatically update the location-based data associated with areas (and/or lighting units) that cause the conflicts. The method 400 can then proceed with mapping the lighting units to the lighting requirements 460, and checking for conflicts 470. In another embodiment, when conflicts are detected or adjustments needed, the central control apparatus can return to defining clusters from the location-based data 430 to adjust the cluster definitions before associating each of the clusters with the lighting units from location information for the lighting units 450 and automatically adjusting the associations to cure the conflicts.

When no conflicts are detected or adjustments needed 462, the central control apparatus can present the final lighting requirements output plan to the user for confirmation 474. In one embodiment, when the central control apparatus is not able to automatically cure the conflicts, the final lighting requirements output plan can include a conflict warning, so the method 400 can return to defining clusters from the location-based data 430 and the user can manually define clusters from the location-based data 430 through user input 432. The method 400 can then continue until the central control apparatus once again presents the final lighting requirements output plan to the user for confirmation 474.

When the user confirms the final lighting requirements output plan 474, the lighting requirements of the clusters associated with each of the lighting units can be implemented 480. In one embodiment, the implementation includes sending the final lighting requirements output plan to a planning/optimization module in the central control apparatus for use in planning, change management, and/or optimization of operation on the outdoor lighting network. In another embodiment, the implementation includes sending the final lighting requirements output plan to the lighting units.

FIG. 5 is an exemplary embodiment of a cluster definition graphical user interface for an outdoor lighting network in accordance with the invention. Clusters can be defined from location-based data in the method of OLN lighting requirements generation as discussed in conjunction with FIG. 4 above. In one example, the clusters can be defined from the location-based data by presenting the location-based data on a map as candidate clusters and defining the clusters from the candidate clusters selected by a user.

Referring to FIG. 5, the GUI 500 can include a background 502 with location-based data presented on the background 502. The location-based data can be any data of interest (e.g., traffic data, safety/crime data, etc.) which is associated with any location of interest. The location-based data can be separated into data groups by values of the specific characteristic associated with the data, i.e., separated into data groups with values above a threshold, below a threshold, or in a particular range. The data groups can then be presented on the background 502 as different candidate clusters, with distinguishing indicia such as pattern or color highlighting the candidate clusters on the background 502. The user can then define one or more clusters by selecting candidate clusters of interest. More than one type of location-based data can be presented on a single background (e.g., safety/security data and/or lighting performance data, with the traffic data) and the user can simultaneously select different candidate clusters of different types to define a meta-cluster.

In this example, the background 502 is a street map and the location-based data are traffic intensity statistics, which are presented as one candidate cluster 510 for high intensity traffic areas and two candidate clusters 512, 514 for medium intensity traffic areas. The candidate cluster 510 is presented as a bounded region with narrow line fill and the candidate clusters 512, 514 are presented as bounded regions with wide line fill. The user can select a candidate cluster with a mouse or other pointing device to define the candidate cluster as a cluster. For example, the user can define the candidate cluster 512 as a cluster by clicking on the candidate cluster 512. Those skilled in the art will appreciate that the presentation of candidate clusters is not limited to bounded regions on the background 502. In another example, the location-based data can be presented by gradients of color and the user can define the clusters by circling particular regions of the location-based data using a mouse or other man-machine interface.

Those skilled in the art will appreciate that the outdoor lighting network control system is not limited to lighting management and public safety applications, but can be used aesthetically for beautification and entertainment. In one example, the lighting units can change brightness, color, and direction throughout the day and evening to light areas of a city to the best effect. In another example, the brightness, color, direction, and flashing state of the lighting units can be changed as an artistic display. In yet another example, the brightness, color, direction, and flashing state of the lighting units can be changed as an artistic display synchronized with a public performance such as music, fireworks, or the like.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting requirements generation system for an outdoor lighting network having lighting units, the system comprising:

a central control apparatus;

a plurality of lighting unit control apparatus; and a communication system operably connecting the central control apparatus and the lighting unit control apparatus;

wherein the central control apparatus is operable to:

acquire location-based data selected from the group consisting of regulatory data, traffic data, security data/crime statistics data, and local area/zoning classifications data;

define clusters from the location-based data, wherein said clusters represent one or more parameter characteristics associated with a particular geographical location/area, wherein said parameter characteristics are selected from the group consisting of area classification clusters, traffic base clusters and safety/security clusters;

define lighting requirements for each of the clusters;

associate the lighting units to the clusters from location information for the lighting units; and map the lighting units to the lighting requirements.

2. The apparatus of claim 1 wherein the central control apparatus is further operable to implement the lighting requirements of the clusters associated with each of the lighting units.

3. The apparatus of claim 1 wherein the central control apparatus is operable to (1) map the lighting units to the lighting requirements by determining a cluster set of the clusters associated with one of the lighting units and (2) define the lighting requirements by a process selected from the group consisting of a max/min process, a pre-defined requirements for meta-cluster process, and a weighted sum process.

4. The apparatus of claim 1 wherein the central control apparatus is operable to check for conflicts between lighting requirements of two or more of the location-based data with a cluster associated to at least one of the lighting units.

5. The apparatus of claim 4 wherein the central control apparatus is operable to resolve the conflicts, when found, by one or more of re-defining clusters from the location-based data, re-defining lighting requirements for the cluster or re-associating the least one of the lighting units to the cluster or generating a conflict warning signal.

6. A central control apparatus of a lighting requirements generation system for an outdoor lighting network having lighting units and being operably connected to server, the apparatus comprising:

a processor;

a memory operably connected to the processor; and a communication module operably connected to the processor for communication with the server;

wherein the processor is operable to:

acquire location-based data selected from the group consisting of regulatory data, traffic data, security data/crime statistics data, and local area/zoning classifications data, from the server;

define clusters from the location-based data, wherein said clusters represent one or more parameter characteristics associated with a particular geographical location/area, wherein said parameter characteristics are selected from the group consisting of area classification clusters, traffic base clusters and safety/security clusters;

define lighting requirements for each of the clusters;

associate the lighting units with the clusters from location information for the lighting units; and map the lighting units to the lighting requirements;

implement the lighting requirements of the clusters associated with each of the lighting units.

7. The apparatus of claim 6 wherein the processor is further operable to implement the lighting requirements of the clusters associated with each of the lighting units.

8. The apparatus of claim 6 wherein the processor is operable to (1) map the lighting units to the lighting requirements by determining a cluster set of the clusters associated with one of the lighting units and (2) define the lighting requirements by a process selected from the group consisting of a max/min process, a pre-defined requirements for meta-cluster process, and a weighted sum process.

9. The apparatus of claim 6 wherein the processor is operable to check for conflicts between lighting requirements of two or more of the location-based data with a cluster associated to at least one of the lighting units.

10. The apparatus of claim 6 wherein the processor is operable to acquire the location-based data through a graphic user interface.

11. The apparatus of claim 6 wherein the processor is operable to resolve the conflicts, when found, by one or more of re-defining clusters from the location-based data, re-defining lighting requirements for the cluster or re-associating the least one of the lighting units to the cluster or generating a conflict warning signal.

12. A method of generating lighting requirements for an outdoor lighting network (OLN) having lighting units and being operably connected to server the method comprising:

acquiring location-based data from the server;

defining clusters from the location-based data selected from the group consisting of regulatory data, traffic data, security data/crime statistics data, and local area/zoning classifications data;

defining lighting requirements for each of the clusters, wherein said clusters represent one or more parameter characteristics associated with a particular geographical location/area, wherein said parameter characteristics are selected from the group consisting of area classification clusters, traffic base clusters and safety/security clusters;

associating the lighting units with the clusters from location information for the lighting units; and mapping the lighting units to the lighting requirements.

13. The method of claim 12 further comprising implementing the lighting requirements of the clusters associated with each of the lighting units.

14. The method of claim 12 wherein the step of mapping the lighting units to the lighting requirements includes determining a cluster set of the clusters associated with one of the lighting units and the step of defining the lighting requirements includes a process selected from the group consisting of a max/min process, a pre-defined requirements for meta-cluster process, and a weighted sum process.

15. The method of claim 12 further including the step of checking for conflicts between lighting requirements of two or more of the location-based data with a cluster associated to at least one of the lighting units.

16. The method of claim 12 further including the step of resolving conflicts, when found, by one or more of re-defining clusters from the location-based data, re-defining lighting requirements for the cluster or re-associating the least one of the lighting units to the cluster or generating a conflict warning signal.

* * * * *